United States Patent [19]

Williams

[11] Patent Number: 4,529,134

[45] Date of Patent: Jul. 16, 1985

[54] SELF-CLEARING SHREDDING APPARATUS AND METHOD OF OPERATION THEREOF

[75] Inventor: Robert M. Williams, Ladue, Mo.

[73] Assignee: Williams Patent Crusher and Pulverizer Company, St. Louis, Mo.

[21] Appl. No.: 463,481

[22] Filed: Feb. 3, 1983

[51] Int. Cl.[3] ..... B02C 25/00

[52] U.S. Cl. ..... 241/30; 241/35; 241/36; 241/236; 241/285 B

[58] Field of Search ..... 241/30, 32, 34, 35, 241/36, 235, 236, 260.1, 285 A, 285 B

[56] References Cited

U.S. PATENT DOCUMENTS

| | | | |
|---|---|---|---|
| 3,868,062 | 2/1975 | Cunningham et al. | 241/36 |
| 4,034,918 | 7/1977 | Culbertson et al. | 241/36 |
| 4,040,571 | 8/1977 | Lindeborg | 241/36 X |
| 4,351,485 | 9/1982 | Hardwick et al. | 241/36 |
| 4,423,844 | 1/1984 | Sours et al. | 241/36 X |

*Primary Examiner*—Howard N. Goldberg
*Assistant Examiner*—Timothy V. Eley
*Attorney, Agent, or Firm*—Gravely, Lieder & Woodruff

[57] ABSTRACT

A self-clearing shredding apparatus for disposal of waste material which includes hard to crush or shred objects, in which the apparatus is provided with individually driven pair of cutter shafts in a common horizontal plane for reducing the waste material or for converting the cutter shaft operation to one in which they perform the duty of a conveyor to transport the objects which are objectionable through a side opening. The apparatus which performs the above activity is connected up to a programmable controller which causes the apparatus to operate in a prescribed method.

3 Claims, 4 Drawing Figures

SELF-CLEARING SHREDDING APPARATUS AND METHOD OF OPERATION THEREOF

BACKGROUND OF THE INVENTION

1. Field of the Invention

This invention relates to rotary shredder apparatus with provision for ejecting hard to shred waste in a self-clearing cycle.

2. Description of the Prior Art

It is well understood in the processing of waste material, like municipal waste, that large uncrushables and hard to shred material is encountered. In instances when the uncrushables and hard to shred material is encountered the shredder jams the shafts on which the shredding, cutting and ripping discs are carried. Often the apparatus must be stopped and the material causing the jam removed by hand. The hand unloading results in loss of productivity of the apparatus to reduce the waste material.

Shredder apparatus known to have means for relieving jams when material gets into the shredding cutters is exemplified by Culbertson, et al U.S. Pat. No. 4,034,918 of July 1977 and by Cunningham, et al U.S. Pat. No. 3,808,062 of Feb. 25, 1975. However, in these examples, the apparatus is operated in a series of shaft reversal cycles in an effort to shred or reduce the offending material sufficiently to eventually send it through the apparatus. The foregoing examples have led to the type of shredding machine which is able to disgorge the hard to shred material, as disclosed in Hardwick et al U.S. Pat. No. 4,351,485 of Sept. 28, 1982. In this patent the shredding shafts are not in a common plane but the plane is inclined to the horizontal so one shaft is lower than the other. Upon shaft reversal the lowest shaft is rotated in a direction to move the material through a side door which opens upon shaft reversal. In this manner, hard to shred or cut material is moved out of the hopper.

A problem with the apparatus of U.S. Pat. No. 4,351,485 is that material may not clear from the higher one of the shafts and upon reversal of both shafts, the highest shaft can retain or withhold the unwanted material away from the lower shaft. Another problem is that the waste material can accumulate over the lower shaft position which results in an uneven distribution of the waste material in the hopper which can prolong the time necessary to process the material as the high shaft works against the low shaft.

BRIEF DESCRIPTION OF THE INVENTION

The apparatus of this invention operates to clear out uncrushables, hard to shred and large waste material by causing the normally contra-rotating shafts to perform predetermined reverse-forward cycles, or to convert the shafts and the shredding discs thereon to act as a conveyor to move such material toward an outlet which has been opened only if the predetermined cycles of reverse-forward rotation has failed to overcome the material.

An important object of the invention is to provide rotary shredding apparatus with an operating method for clearing uncrushables and similar objectionable waste material by following the steps of normally rotating the counter-rotating cutter shafts to draw the waste material down between the cutter shafts which is capable of being ripped and shredded, sensing the presence of uncrushables when the cutter shafts stop due to such material, and converting the operation of the cutter shafts into a mode in which they rotate in the same directions to have the cutters act as conveyors to move the objectionable material through a discharge which has opened in response to the converting of the cutters into a conveyor.

The foregoing object is carried out by an embodiment of apparatus having a pair of parallel spaced-apart driven cutter shafts carrying co-acting and overlapped disc-type cutter elements, and in which each shaft is connected to a reversible hydraulic motor means operatively contained in hydraulic fluid circuit means having pumping means for each motor means, hydraulic fluid flow reversing means in the fluid circuit for each motor means, means for opening a discharge door in the material receiving hopper, and electrical control means including sensor means responsive to stoppage of the cutter shafts for selecting predetermined modes of response resulting in the control means operating the cutter shafts in a mode to convey the material through the discharge door for self-clearing action.

BRIEF DESCRIPTION OF THE DRAWINGS

The preferred embodiment and modification thereof are shown in the accompanying drawings, wherein.

DESCRIPTION OF THE PREFERRED EMBODIMENT

Figure 1:
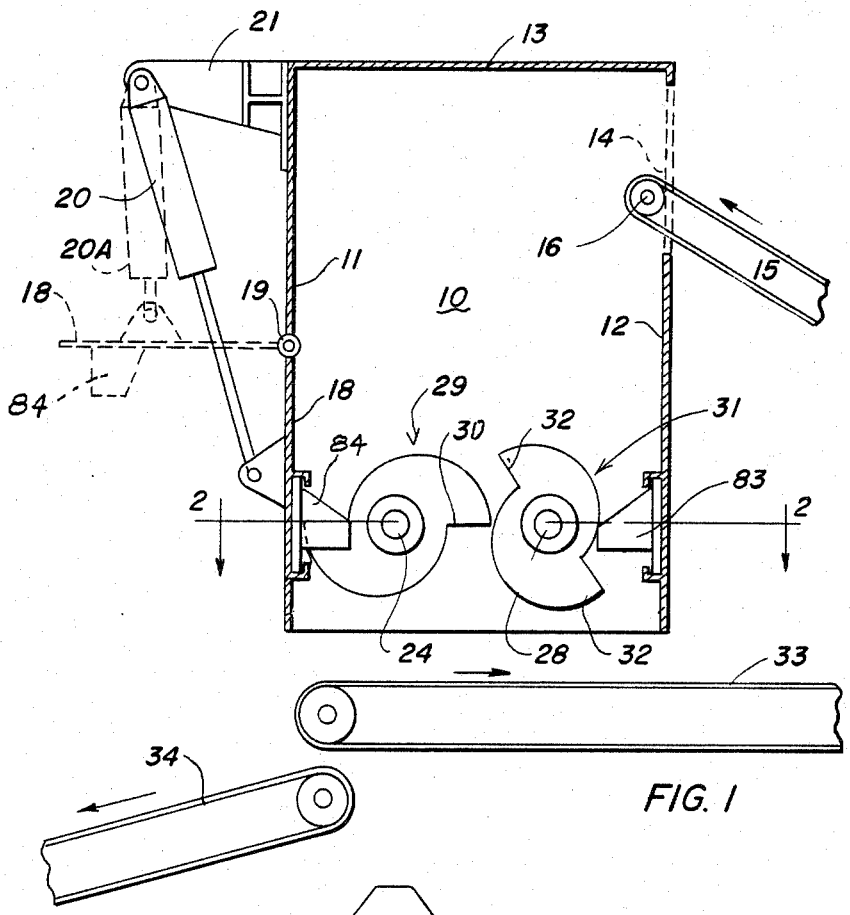
FIG. 1 is a vertical sectional view of shredder apparatus by which the principles of the invention may be carried out.

In the normal shredding of municipal waste large uncrushables are constantly encountered. Such uncrushables will generally jam any slow speed shear-type shredder and it is necessary to manually unload this sort of material which results in down time and loss of productivity. A partial solution to the problem of clearing uncrushables from shredding machines is disclosed in Hardwick et al U.S. Pat. No. 4,351,485 where tramp material causing a crash-stop results in disengaging the drive motor so an access door can be opened for manual removal, but if the jam is less serious, the cutters can be run through a series of reversals in an attempt to clear the obstruction without opening the hopper access door.

The present apparatus is arranged to self-clear uncrushables by means which will detect a jam condition and discharge material of uncrushable character by converting the rotary cutter shafts and cutter discs into a conveyor for moving the material out of the hopper through a discharge opening controlled by a movable door. No manual removal of the uncrushable material is necessary as the removal is carried out as indicated through using the rotating cutter discs and shafts as a conveyor to support and move such material to and through a side door in the wall of the hopper.

The apparatus is constructed with a hopper 10 made up of sheet or plate material to form side walls 11 and 12, a top closure 13, and an opening 14 to allow the material feed belt 15 to have its discharge end extending through the opening 14 on a pulley 16. The wall 11 carries a door 18 movable on a horizontal hinge 19 so it can swing outwardly of the hopper 10 in response to the action of a pair of hydraulic cylinders 20 (one being seen in FIG. 1) constituting motor means supported by suitable brackets 21. One end wall 21 supports a bearing 21A for shaft 28, a gear box 22 in which gears form the connection between a hydraulic low speed, high torque radial piston motor 23 and a shaft 24 in the bottom open end of the hopper 10. The opposite end wall 25 supports a bearing 25A for shaft 24, and a second gear box 26 connecting the hydraulic low speed radial piston motor 27 to a second shaft 28 in the hopper 10. As will be referred to presently, the shafts 24 and 28 are disposed in a horizontal plane so that the use thereof as a conveyor will be aided.

Shaft 24 carries a plurality of disc-type cutters 29 formed with cutting teeth 30. Shaft 28 carries a plurality of disc-type cutters 31 formed with cutting teeth 32. The cutters 29 and 31 interleaf with each other and have close running side surfaces to develop a shearing action. The motors 23 and 27 operate through the respective gears in boxes 22 and 26 so that shaft 24 turns faster than shaft 28. The shaft speed differential can be achieved by selective gear rations in boxes 22 and 26, or it can be achieved by one pump having a greater displacement than the other. This relative difference in rotation causes the cutters to develop a ripping and tearing action during shredding. However, when difficult material like rubber is encountered the cutters tend to pull into synchronism and the action is essentially one of shearing, and because of this type of action the clearance between cutter side faces is set for approximately 0.005 inches.

When uncrushables are encountered the cutters jam and stop shaft rotation. The stoppage of either shaft 24 or 28 is detected, as will be explained presently, and the control system of FIG. 3 will be operative to cycle the motors 23 and 27 in a reverse-forward mode for a predetermined number of cycles, usually three, to try to shred the material causing the jam. If in the cyclic mode the jam continues to be present, the control system goes into an ejection mode which has several phases. The first phase is to cause the shafts to rotate in opposite directions so the teeth move away from each other to disgorge the material from between the shafts. The next phase is to return shaft 24 to its normal forward rotation so that the teeth 30 will drive or force the uncrushable material onto the cutters 31 on shaft 28. In this mode both shafts are rotating in the same direction (clockwise) to move the material toward the hopper side wall 12. The next mode involves energizing the hydraulic cylinder means 20 to open the side door 18 and at the same time the rotation of both motors 23 and 27 is reversed to cause the cutters 29 and 31 to turn in a counterclockwise direction so the material will be conveyed toward the open side 11 and discharged from the hopper 10. The side door 18 covers a large opening so large objects and uncrushables can easily be discharged by the action of the cutters being converted to a conveyor by rotating in the same direction.

As long as the shredder can function to shred material without jamming the material will drop out below the shafts 24 and 28 and be collected on a belt conveyor 33 for delivery to a collection zone. When it is necessary to cause the shredder to operate as explained when a jam occurs, the material discharged through the door, when door 18 is opened, will fall onto a second belt conveyor 34 and be delivered to a different collection zone. The cycle for discharging uncrushables or clearing the shredder of a jam condition is normally adjusted for a limited time, as experience determines, and when the time runs out the shredder is returned to its normal condition of counter-rotating shafts in which the cutter teeth turn toward each other.

OPERATION OF THE APPARATUS

Figure 2:
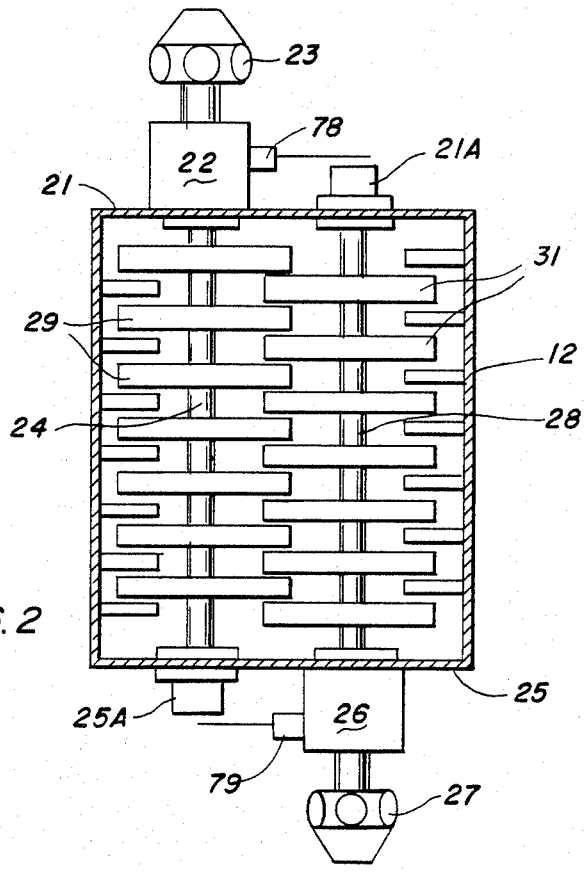
FIG. 2 is a plan view of the apparatus seen along line 2—2 in FIG. 1.
Figure 3:
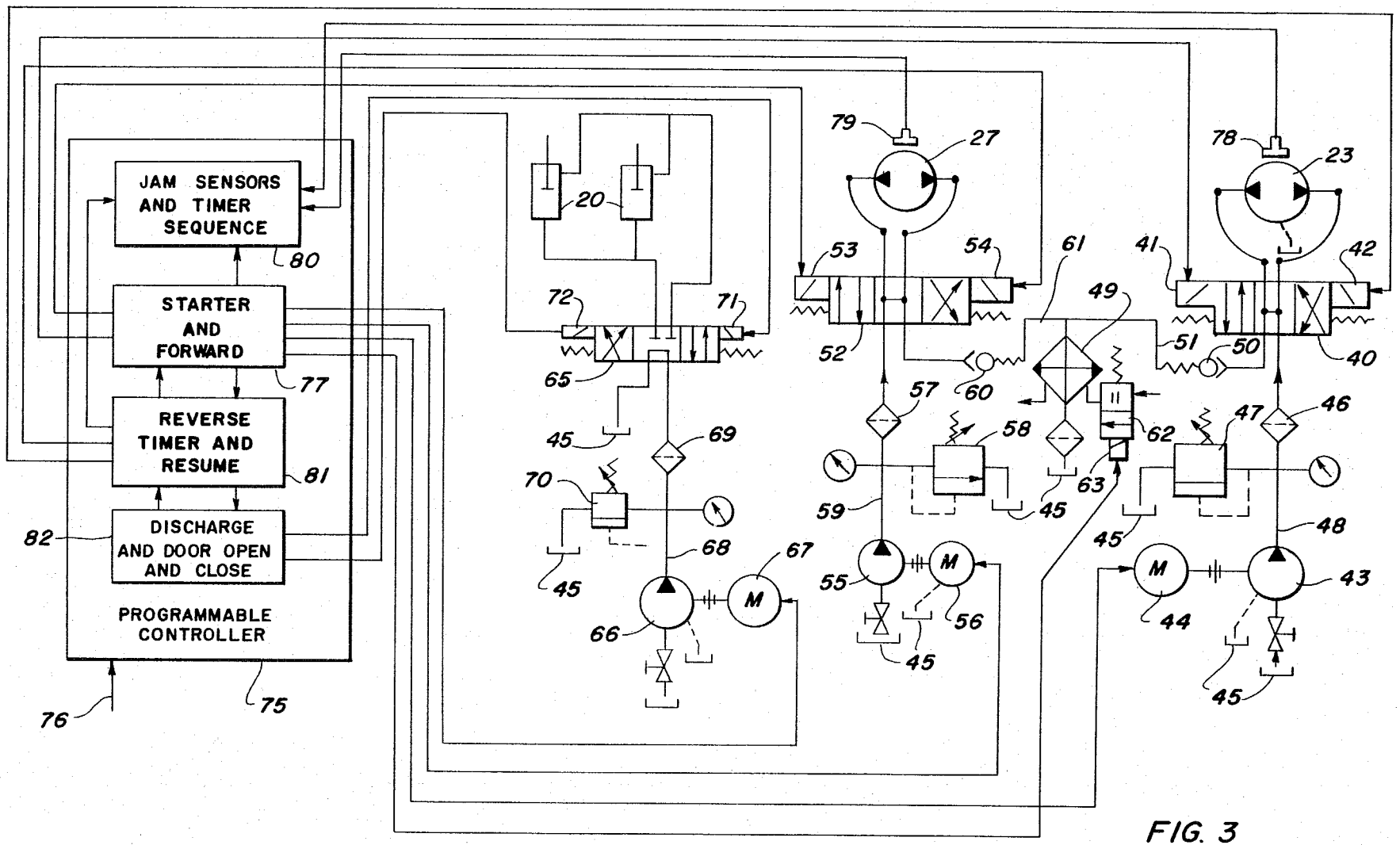
FIG. 3 is a schematic electrical and hydraulic control system adapted to operate the apparatus of this invention.

Turning now to FIG. 3, there is disclosed the schematic electrical and hydraulic control system for the apparatus described in FIGS. 1 and 2. The radial piston drive motor 23 for the cutter shaft 24 is provided with a common type of four way - three position valve 40 operated in response to solenoid 41 for normal forward rotation, and in response to solenoid 42 for normal reverse rotation. The hydraulic fluid is supplied from pump 43 driven by electric motor 44 to deliver the fluid from reservoir 45 through a filter 46 to the valve 40. A pressure relief control 47 of common type is connected into the delivery conduit 48 to by-pass the motor 23 upon a pressure rise above the desired operating pressure. In the neutral position of the valve 40 there is a flow cross-over so the flow can return directly to the reservoir when it is not desired to operate the motor 23. The return to reservoir 45 is through a water cooled exchanger 49 and a check valve 50 is in the return conduit 51 for a purpose to appear.

The second radial piston motor 27 for cutter shaft 28 is provided with a common type of four way - three position valve 52 operated in response to solenoid 53 for normal forward rotation, and in response to solenoid 54 for normal reverse rotation. The hydraulic fluid is supplied from pump 55 driven by electric motor 56 to deliver the fluid from reservoir 45 through a filter 57 to the valve 52. A pressure relief control 58 of common type is connected into the delivery conduit 59 to by-pass the motor 27 upon a pressure rise above the desired operating pressure. In the neutral position of valve 52 there is a cross-over so the flow can return directly to the reservoir 45 when it is not desired to operate motor 27. The return to reservoir 45 is through the water cooled exchanger 49 for the motor 23. A check valve 60 is inserted in return conduit 61. It is important to set the check valves 50 and 60 so there will be no cross-over flow between the hydraulic valves 40 and 52.

The heat exchanger 49 receives cooling water through a valve 62 controlled by a solenoid 63 which normally shuts off the water flow when the hydraulic systems for the motors 23 and 27 are not in operation.

It was disclosed in FIG. 1 that the discharge door 18 in the side wall 11 of the hopper 10 is moved between its open and closed positions by a pair of cylinder and piston motor means 20. These motor means 20 operate in synchronism in response to a common four way - three position valve 65. This valve 65 differs from the previously described valves 40 and 52 in that in the neutral position the motor means 20 are held in whatever position attained when the valve 65 goes to its neutral position. In normal operation, a pump 66 driven by an electric motor 67 delivers pressure fluid in conduit 68 through a filter 69 to the valve 65. A pressure relief valve 70 is connected into conduit 68 to protect the motor means 20. Valve 65 is operated in a door opening direction by solenoid 71, and in the door closing direction by solenoid 72.

The several pieces of operating equipment just referred to are under the direction and control of a programmable controller 75 which has its main power supplied from lead 76. The controller comprises certain subcontrols which are identified by suitable legends. The subcontrol 77 initiates the starter and forward modes of operation. For example, the starter mode is intended to energize the respective electric motors 44, 56 and 67 to develop hydraulic pressure in the respective systems, and to energize solenoid 63 to supply cooling water to the exchanger 49. The operator normally presses a start button to condition the respective hydraulic systems. A start signal (not shown) indicates that the hydraulic systems are functional, and at that time, if waste material is available, a forward shred button (not shown) needs to be pressed to energize solenoid 41 at valve 40 for motor 23 and to energize solenoid 53 at valve 52 for motor 27 so that pressure fluid is delivered to drive the radial piston motors 23 and 27 in counter-rotating directions so the cutter teeth 30 and 32 turn toward each other. If the waste material can be reduced without problems, the forward or shred mode will continue unchanged, and the valve 65 in control of the motors 20 for door 18 will not be moved out of its neutral setting with the door closed.

Now, if some waste material is received in the hopper 10 that is too tough for the cutter teeth 30 and 32 to shear through, or that causes the gears in gear boxes 22 and 26 to momentarily stop turning, motion sensor means 78 or 79, or both, will detect that stoppage and generate signals which are received in sub-circuit 80 to be monitored in terms of how long the stoppage persists. The sub-circuit 80 works in association with a sub-circuit 81 which, when signalled, will deenergize the forward solenoids 41 and 53 at valves 40 and 52 respectively, and energize solenoids 42 and 54 to reverse the pressure fluid flow to motors 23 and 27 so the cutter teeth 30 and 32 will disgorge the tough material. This reversal is followed by restoration of the forward mode, and the timer can be set usually to operate the motors 23 and 27 through several forward and reverse cycles in an effort to overcome the difficult material. Usually three such cycles will be sufficient to determine if the apparatus can shred, tear or shear the material.

It is to be understood here that the shredding, tearing action of the teeth 30 and 32 is developed by operating the motor 23 at a shaft speed of about 20 RPM and motor 27 at a shaft speed of 27 RPM. Also, the motor-gear ratio for gear box 22 is about 4 to 1, while the motor-gear ratio for gear box 26 is about 2.96 to 1. These parameters are about what is desired, but no limitation is to be implied therefrom. The principle that governs is that the shafts 24 and 28 are revolving at different speeds so the ripping, tearing and shredding action occurs at all times. An exception does occur when rubber or rubbery material is dumpted into the hopper 10. This type of material has the tendency to drag the faster shaft down so both shafts reach about the same speed, and at that time material is subjected mainly to shearing action.

Returning to the condition when the apparatus encounters material such as uncrushables, the sensors 78 and/or 79 generate a signal which is received in sub-circuit 80 to indicate a jam that has persisted beyond the designated time in the sequence of forward-reverse cycling of motors 23 and 27 controlled in sub-circuit 81. Now, the controller 75 will call for the discharge mode which is in sub-circuit 82. This sub-circuit 82 depends upon functions in sub-circuits 77 and 81. The discharge mode combines a number of functions which converts the shredder shafts and cutters into a conveyor. The first phase of this mode is to operate the solenoid valve 52 so its motor 27 will rotate shaft 28 in a clockwise direction, and to operate solenoid valve 40 so its motor 23 will rotate shaft 24 also in a clockwise direction. Now both shafts 24 and 28 will be rotated in the same direction to move the uncrushable material toward the hopper wall 12. After a very short time period, the sub-circuit 82 will execute a second phase of the function which is to energize solenoid 71 so the motors 20 will retract and swing door 18 outwardly to its open (dotted) position. At the same time in this second phase the motors 23 and 27 are caused to rotate shafts 24 and 28 in counterclockwise directions by energizing solenoids 41 and 54 to have the cutters 29 and 31 form a conveyor to carry the uncrushable material to the discharge opening now opened by door 18. The discharge sequence is continued for a predetermined period of time and is then stopped and the door 18 is returned to its closed position by sub-circuit 82 energizing solenoid 72 before returning the valve 65 to its neutral position. At the same time the controller 75 will return the valves 40 and 52 to positions of normal shredding operation under the control by sub-circuit 77.

MODIFIED EMBODIMENT

It is apparent from FIG. 1 that when the door 18 is opened and waste material is continually brought to the hopper 10 by conveyor 15, a quantity of material will be discharged along with the uncrushables. It is also apparent from FIG. 1 that the side wall 12 of the hopper supports a set of comb teeth 83, and that the door 18 supports a similar set of comb teeth 84. These comb teeth 83 and 84 prevent material wedging between adjacent cutter discs 29 or 31, and are well known in this art.

Figure 4:
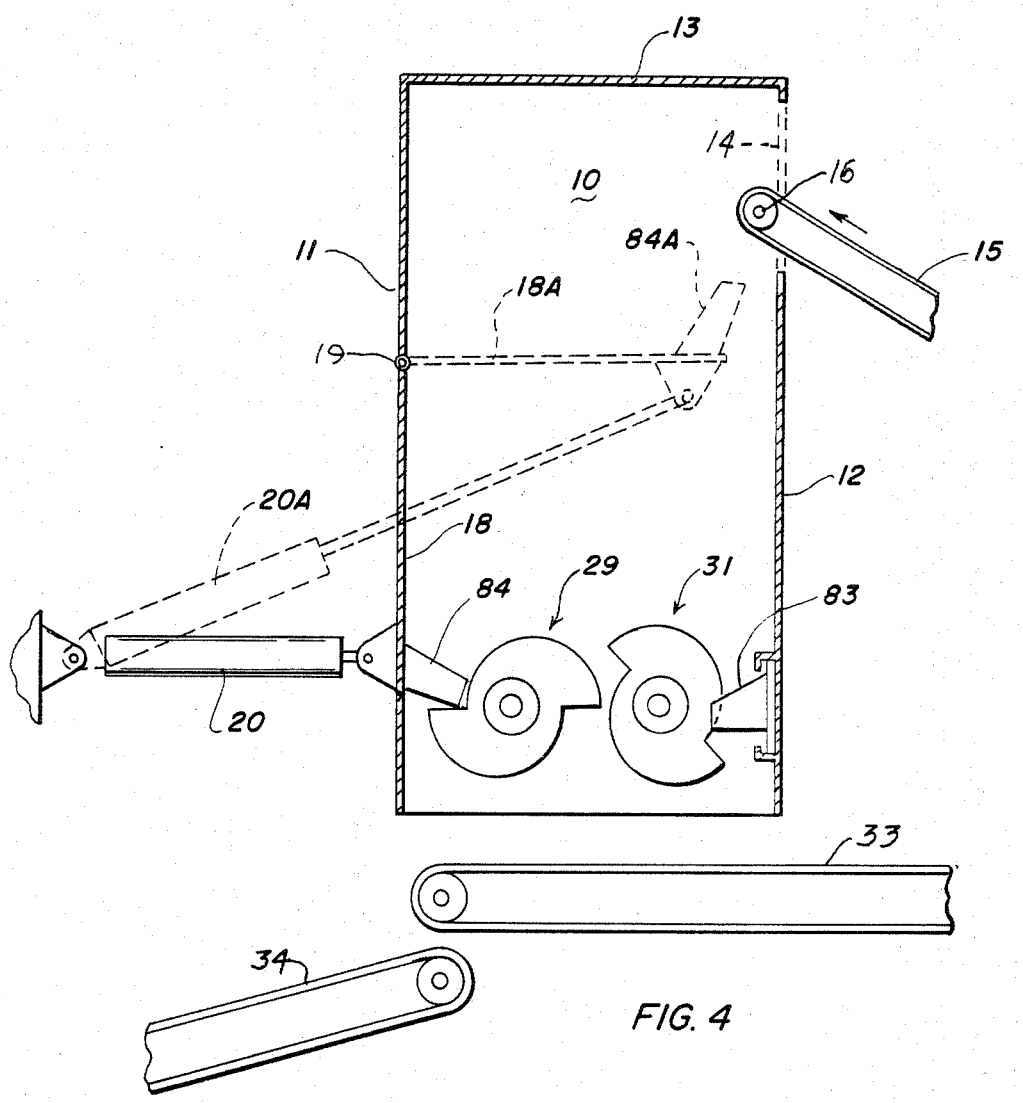
FIG. 4 is a vertical sectional view of a modified shredder in which a number of variations have been made which differ from the view of FIG. 1.

The modification of FIG. 4 includes many components which are repeated from FIG. 1 and will be similarly designated so as to avoid repetitious description. The principal feature of FIG. 4 needing disclosure is in the arrangement of the discharge door 18A and the comb teeth 84A. The door 18A is operated by cylinder motor means 20A which retract in order to close the door 18A and extend to open the door inwardly. This requires a modification in the controller sub-circuit 82 which should be understood from the foregoing disclosure. Another modification is the shape of the comb teeth 84A so that sufficient clearance is obtained when the door 18A opens and moves the teeth 84A upwardly in the hopper. The purpose for swinging the door 18A inwardly into the hopper 10 is to allow the door to block off incoming waste material from the cutter shafts and not allow a quantity of recoverable waste material to be discharged with the uncrushables.

RESUME

The foregoing disclosure is directed to a unique method of operating a self-clearing shredder apparatus to clear out uncrushables without requiring manual operations and with a minimum of down time of the apparatus. The method embodies the steps of going from normal shredding operation to a step of sensing the presence of uncrushables which cause stoppage of the rotary shafts, followed by the steps of forward-reverse cycling of the cutter shafts in an effort to rip or shear through the material to try to clear the uncrushables, shifting the operation to rotating the shafts in common directions to convert the cutters into a co-acting mode to form a conveying surface and to open a discharge so the uncrushables can be removed from the apparatus.

In order to accomplish this unique method, the apparatus is seen to have a pair of parallel spaced-apart driven cutter shafts carrying cutter elements, which shafts and elements are driven by hydraulic motor means, one connected to each shaft, connected into hydraulic fluid circuits having fluid flow reversing means subject to a programmable controller for selecting predetermined modes of response when sensor means respond to the presence of uncrushables resulting in the stoppage of the motor drive means.

There has been set forth and described what is considered to be a preferred embodiment of the present invention for the disposal of waste material and the self-clearing of uncrushables from the apparatus. It is possible to make modifications in the selection of components and controls without departing from the principles of this invention as presently illustrated, but the same is not intended to impose limitations on the spirit in which this disclosure is made.

What is claimed is:

1. The method of operating a self-clearing material reducing apparatus having a material receiving hopper, parallel and independently driven shafts in the hopper, and co-acting cutters on the shafts, the method comprising the steps of:

(a) disposing the cutter shafts with their axes in a common horizontal plane and their co-acting cutters forming a horizontal material receiving surface;

(b) normally rotating the shafts in a forward counter-rotating direction to draw the material down from the receiving surface into the co-acting cutters and between the shafts for reducing the same;

(c) sensing the presence of hard to shred material in the space between the shafts;

(d) modifying the direction of rotation of the shafts so each rotates in a reverse then forward mode for a limited time to try to reduce the material sensed to be hard to shred;

(e) further modifying the direction of rotation of the shafts into a reverse mode for disgorging the hard to shred material from between the shafts and repositioning the latter material on the material receiving surface;

(f) converting the direction of rotation of the shafts so they rotate in the same direction so the co-acting cutters form a conveyor to support the hard to shred material disgorged from between the shafts;

(g) discharging the hard to shred material out of the hopper by moving it across the hopper on the conveyor formed by the co-acting cutters on the shafts rotating in the same direction; and (h) resuming the normal shaft and cutter rotation in a forward counter-rotating direction for reducing further material.

2. The method set forth in claim 1 which includes the step of simultaneously opening the hopper while substantially blocking the travel of incoming waste material toward the cutter shafts for accommodating the discharge of the hard to shred material upon converting the direction of shaft rotation to act as a conveyor for the hard to shred material.

3. A self-clearing arrangement for material reducing apparatus having a pair of parallel independently driven spaced-apart driven cutter shafts with their axes in a common horizontal plane and carrying co-acting cutter elements, said self-clearing arrangement comprising:

(a) material receiving hopper means having means for receiving the pair of cutter shafts and supporting said shafts in a horizontal plane therein for reducing material placed in said hopper means upon the co-acting cutter elements;

(b) separate drive means for each of the cutter shafts, including reversible hydraulic motor means;

(c) a pair of hydraulic pumping means;

(d) a pair of hydraulic fluid circuit means, each such circuit containing a reversible hydraulic motor means and one of said pair of hydraulic pumping means;

(e) door means operably carried by said hopper means for closing and opening a hopper material discharge opening;

(f) means connected to said door means for operating the same;

(g) hydraulic fluid flow reversing means in each fluid circuit means for reversing the direction of flow of the hydraulic fluid in said fluid circuit means; and (h) electrically operable means for actuating said flow reversing means, including sensor means in each of said separate drive means and control means responsive to said sensor means for selectively:

1. effecting a normal direction of rotation of both of said cutter shafts in forward counter-rotating directions toward each other to shred material,
2. effecting a cycling of rotation of both of said cutter shafts in reverse and forward counter-rotating directions to try to shred hard to reduce material,
3. converting the rotation of both of said cutter shafts to the same direction of rotation such that the cutter elements co-act to form a conveying surface for supporting and transporting hard to shred material toward said discharge opening, and
4. effecting operation of said door means for opening the hopper material discharge opening.

* * * * *